US006149860A

United States Patent [19]

Furukawa et al.

[11] Patent Number: 6,149,860

[45] Date of Patent: Nov. 21, 2000

[54] CARBURIZATION AND QUENCHING APPARATUS

[75] Inventors: Taichiro Furukawa, Hamamatsu; Shingo Mizoguchi; Tadayoshi Yoshioka, both of Shizuoka; Masanori Ichikawa, Fukurio; Yukio Hashimoto, Toyota, all of Japan

[73] Assignee: NTN Corporation, Osaka, Japan

[21] Appl. No.: 09/110,328

[22] Filed: Jul. 6, 1998

[30] Foreign Application Priority Data

Jul. 7, 1997 [JP] Japan ..... 9-181402
Jul. 11, 1997 [JP] Japan ..... 9-186323

[51] Int. Cl.[7] ..... C23C 8/00
[52] U.S. Cl. ..... 266/251
[58] Field of Search ..... 148/233; 266/251

[56] References Cited

U.S. PATENT DOCUMENTS 3,950,192 4/1976 Golland et al. ..... 148/233
5,868,871 2/1999 Yokose et al. ..... 148/211

*Primary Examiner*—Deborah Yee
*Attorney, Agent, or Firm*—McDermott, Will & Emery

[57] ABSTRACT

A carburization and quenching apparatus includes: a plurality of carburizing chambers for carburizing thin plate parts; a gas cooling chamber for cooling the thin plate parts carburized in the carburizing chambers; and a reservoir tank 3 connected to the gas cooling chamber for delivering a cooling gas into the gas cooling chamber. The plurality of carburizing chambers are positioned at an approximately equal distance from the gas cooling chamber to surround the gas cooling chamber.

In a continuous furnace, thin plate parts can be transported successively at least between a carburizing chamber and a pressurized cooling chamber. The thin plate parts are carburized in the carburizing chamber and then rapidly quenched in the pressurized cooling chamber by cooling the thin plate parts with a pressurized gas which can be e.g. inert gas.

9 Claims, 5 Drawing Sheets

CARBURIZATION AND QUENCHING APPARATUS

BACKGROUND OF THE INVENTION

1. Field of the Invention

The present invention relates to a carburization and quenching apparatus and a method of quenching thin plate parts, and in particular to a carburization and quenching apparatus for carburizing and quenching thin plate parts and a method of quenching the same.

2. Description of the Background Art

As a bearing ring of a thrust needle bearing, an annular, thin plate part is employed which is formed of chrome molybdenum steel and has a thickness of approximately 1 mm and a diameter of approximately 60 mm. The thin plate part requires some hardness to provide the function as e.g. a bearing ring. In order to obtain the hardness to provide this function, the thin plate part need be carburized and then quenched.

The carburization and quenching process has conventionally employed continuous furnace of mesh belt type, all-casing furnace and the like. The continuous furnace of mesh belt type requires a wide and long mesh belt and thus disadvantageously requires large space. The all-casing furnace disadvantageously has a limited process capability, since it is not until one batch in the carburizing chamber is completely carburized that the next batch enters the carburizing chamber.

For the conventional continuous furnace of mesh belt type, all-casing furnace and the like, a liquid such as oil is employed for quenching carburized thin plate parts to obtain the hardness depending on the application.

However, quenching thin plate parts with a liquid such as oil will result in an excessive cooling rate of the thin plate parts. The excessive cooling rate, together with the extremely reduced thickness of the thin plate parts, will cause thermal treatment-caused distortion (i.e. warpage) in the thin plate parts. Particularly when thermal treatment-caused distortion is caused in the outer ring of a needle bearing, the bearing ring of a thrust bearing or the like, the rolling element hardly operates normally, resulting in degradation of the performance of the bearing. Thus, distortion removal is required to remove such distortion.

Conventionally, thin plate parts are dipped into and thus cooled in a liquid such as oil, and the liquid will thus adhere to the surfaces of the thin plate parts. This also disadvantageously entails the necessity of the washing step for removing the liquid from the thin plate parts.

Furthermore, conventional gas-cooled furnaces which cool carburized thin plate parts with gas can only provide insufficiently quenched and hardened thin plate parts owing to the dropped temperature of the products, since conventional gas-cooling furnaces require some time to move the tray which carries completely carburized thin plate parts and also require some time to raise the pressure of the cooling gas in the cooling chamber.

For batch furnace, such as conventional all-casing furnaces, it is general that the ambient of carburization in a furnace is adjusted after the temperature of products is raised and the soaking process is completed. Thus, products will be inserted into a furnace which contains a gas for carburization used in the immediately preceding process. As a result, the products will be carburized while the temperature of the products is raised, and thus it has been difficult to provide a thin carburization layer in a thin plate part, such as a bearing ring of a thrust needle bearing.

SUMMARY OF THE INVENTION

One object of the present invention is to provide a carburization and quenching apparatus with high processing capability and capable of presenting thermal treatment-caused distortion of processed products.

Another object of the present invention is provide a thin plate part quenching method capable of readily obtaining hardnesses depending on functions of e.g. bearings and also eliminating the necessity of distortion removal step, washing step and the like.

The carburization and quenching apparatus according to the present invention is provided for carburizing and quenching thin plate parts and includes a plurality of carburizing chambers for carburizing thin plate parts, a cooling chamber for cooling the thin plate parts carburized in the carburizing chambers, and cooling promotion means connected to the cooling chamber for delivering a cooling gas into the cooling chamber, wherein the plurality of carburizing chambers are positioned at an equal distance from the cooling chamber such that they surround the cooling chamber.

For a carburization and quenching apparatus with only one carburizing chamber provided for the single cooling chamber, the parts completely carburized in the carburizing chamber are cooled, i.e. quenched, in the cooling chamber while other parts are carburized in the carburizing chamber. However, if the cooling time in the cooling chamber is shorter than the carburizing time in the carburizing chamber, the parts in the cooling chamber will be completely cooled before the next parts are completely carburized in the carburizing chamber. Thus, the cooling chamber will not be in use until the next parts are completely carburized.

The carburization and quenching apparatus of the present invention includes a plurality of carburizing chambers provided for one cooling chamber. If the parts in the cooling chamber are completely cooled prior to completion of carburization of another parts in a carburizing chamber, still another parts in another carburizing chamber that have been completely carburized can be cooled in the cooling chamber. Thus, the cooling chamber is always in use and the processing capability of the apparatus can be improved.

In the apparatus according to the present invention, it is not necessary that each carburizing chamber should be provided with a respective cooling chamber and the apparatus thus only requires one cooling chamber. Thus, the apparatus can be miniaturized as compared with that with each carburizing chamber provided with a respective cooling chamber.

Furthermore, since the plurality of carburizing chambers are positioned such that they surround the cooling chamber, the thin plate parts completely carburized in a carburizing chamber can rapidly be moved into and thus cooled in the cooling chamber to ensure quenching of the thin plate parts.

Furthermore, the cooling promotion means provided for delivering the cooling gas allows completely carburized thin plate parts to be cooled rapidly.

Preferably, the cooling chamber is provided with cooling rate adjustment means for adjusting the rate at which thin plate parts are cooled by the cooling gas, so that the thin plate parts can be quenched optimally.

The cooling gas is preferably inert gas to ensure that thin plate parts are quenched, since inert gas does not chemically react with the thin plate parts.

A thin plate part is preferably a bearing ring of a thrust needle bearing to obtain a large number of bearing rings that are less distorted and also have high precision.

Preferably, the carburization and quenching apparatus also includes a heating chamber for heating thin plate parts before they are carburized. Heating thin plate parts previously in the heating chamber and then delivering them into a carburizing chamber eliminates the necessity of raising the temperature of the thin plate parts in the carburizing chamber and the thin plate parts will thus be prevented from carburization while their temperature is otherwise raised. As a result, thin plate parts can be formed which have a predetermined thin carburization layer.

In a thin plate part quenching method according to the present invention, thin plate parts can be moved in a continuous furnace at least between carburizing chambers and a cooling chamber successively and the thin plate parts completely carburized in a carburizing chamber are rapidly transported into and quenched in the cooling chamber, wherein the thin plate parts are quenched in a such manner that the thin plate parts are cooled with gas.

According to the thin plate part quenching method according to the present invention, thin plate parts are quenched with gas. Gas is slower than liquid in the cooling rate of thin plate parts and can also be adjusted in pressure and type to readily control the cooling rate of the thin plate parts. Thus, the thin plate parts can be provided with various hardnesses depending on functions, applications and the like, and thermal treatment-caused distortion can also be reduced in the thin plate parts. Accordingly, the necessity of distortion removal can be eliminated to reduce the number of the steps for processing the thin plate parts.

Quenching thin plate parts with gas eliminates the step of washing the liquid off the thin plate parts, as in quenching them with liquid, and hence eliminates the step of washing the thin plate parts.

Preferably the pressure of the gas in the cooling chamber is adjusted to cool thin plate parts under pressure so that the thin plate parts can be provided with hardness depending on function, application and the like and also effectively prevented from thermal treatment-caused distortion.

In quenching thin plate parts, preferably the gas in the cooling chamber is agitated and the rate and time of the agitation are thus adjusted so that the thin plate parts can be provided with hardness depending on function, application and the like and also effectively prevented from thermal treatment-caused distortion.

Preferably, a thin plate part has its main surface exposed to a gas in a well-regulated flow substantially parallel to the main surface. Thus, the thin plate part is less likely to be cooled unevenly. Consequently the thin plate part can uniformly be cooled to prevent warpage.

Preferably the thin plate part is ring-shaped to result in less distortion and prevent liquid adhesion so that a highly precise ring-shaped thin plate part can readily be obtained.

Preferably the thin plate part is also a bearing ring of a thrust bearing to result in less distortion and prevent liquid adhesion so that a highly precise bearing ring of a thrust bearing can readily be obtained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will now be described with reference to the drawings.

First Embodiment

Figure 1:
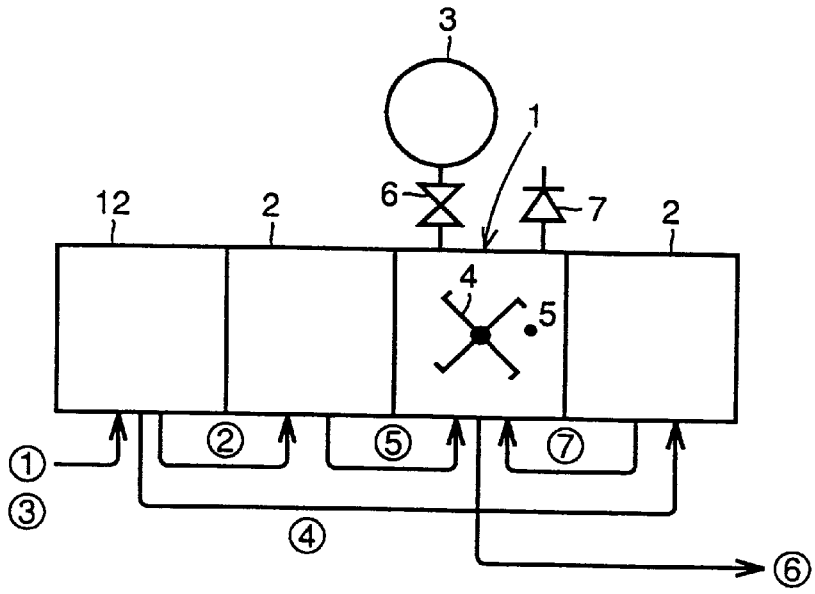
FIG. 1 is a schematic plan view of a carburization and quenching apparatus according to a first embodiment of the present invention.

Referring mainly to FIG. 1, a carburization and quenching apparatus according to the present invention includes: a gas cooling chamber 1; e.g. two carburizing chambers 2 adjacent to and surrounding gas cooling chamber 1; and a reservoir tank 3 as cooling promotion means connected to gas cooling chamber 1 via a valve 6. A heating chamber 12 is provided adjacent to a carburizing chamber 2.

Figure 2:
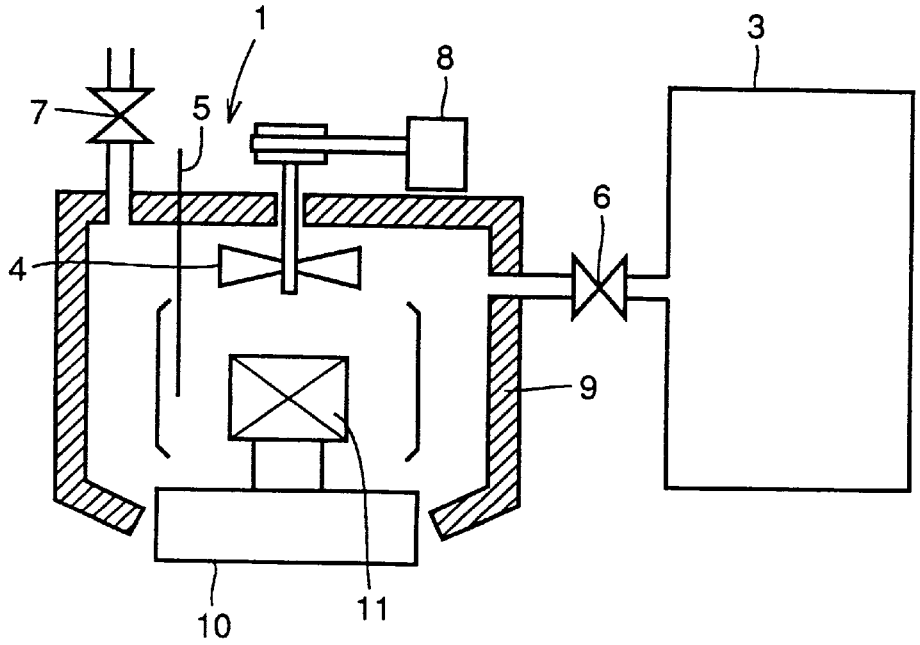
FIG. 2 is a schematic cross section of the gas cooling chamber shown in FIG. 1.

Referring mainly to FIG. 2, gas cooling chamber 1 includes a cooling container 9, an agitator fan (propeller) 4 provided in cooling container 9, a motor 8 for revolving agitator fan 4, a thermocouple 5 for measuring the temperature in cooling container 9, and an exhaust valve 7. Agitator fan 4, thermocouple 5 and motor 8 configure cooling rate adjustment means. In cooling thin plate parts in gas cooling chamber 1, a basket 11 placed on a transport table 10 as transport means is delivered into cooling container 9.

Figure 3:
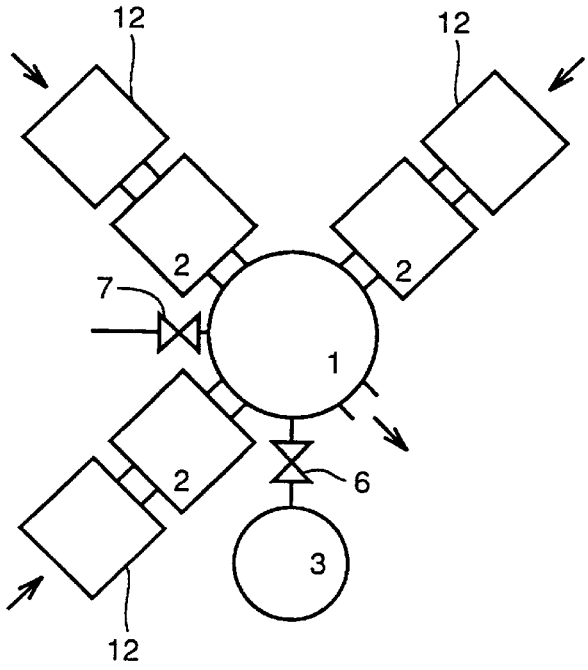
FIG. 3 is a schematic plan view of a variation of the carburization and quenching apparatus according to the present invention.

As shown in FIG. 3, gas cooling chamber 1 may be surrounded by three carburizing chambers 2, each carburizing chamber 2 provided with a heating chamber 12 adjacent thereto. More than three carburizing chambers 2 may be provided for one gas cooling chamber 1.

A procedure will now be described for carburizing and quenching thin plate parts employing the apparatus shown in FIGS. 1 and 2.

Figure 4:
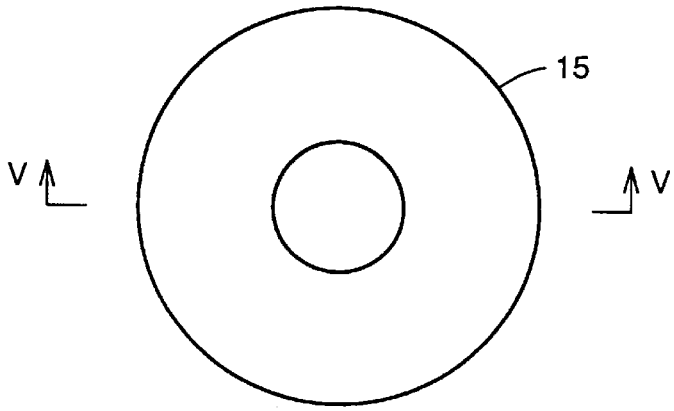
FIG. 4 is plan view of a thin plate part to be carburized and quenched.
Figure 5:
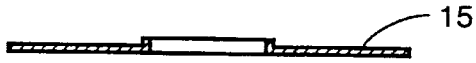
FIG. 5 is a cross section taken along line V—V of FIG. 4.
Figure 6:
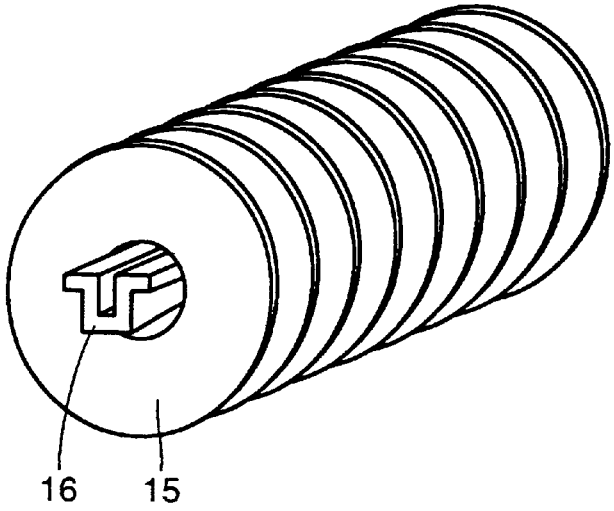
FIG. 6 is a perspective view of thin plate parts supported by a jig.
Figure 7:
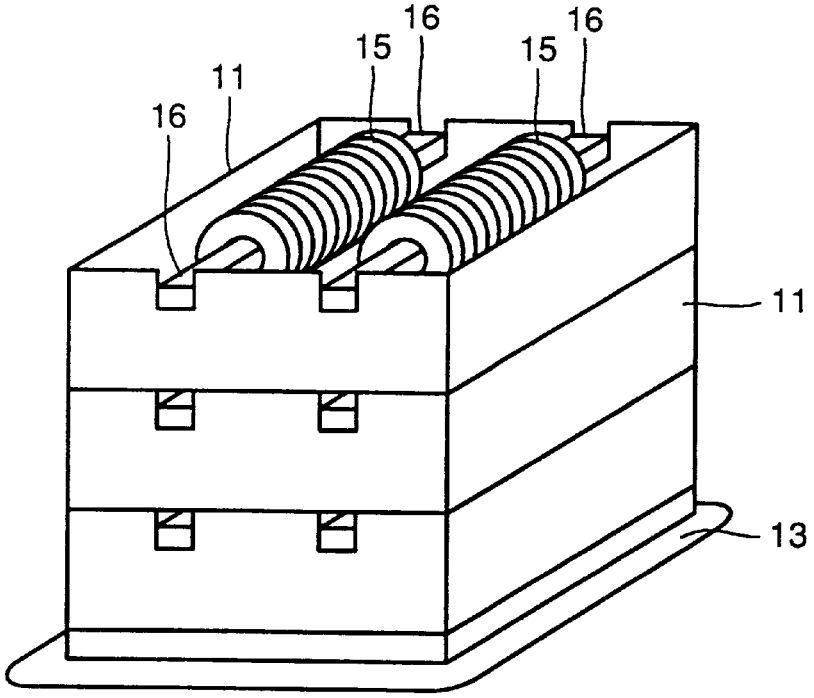
FIG. 7 is a perspective view of a basket and a tray for accommodating thin plate parts.

Unquenched thin plate parts 15 as shown in FIGS. 4 and 5 are prepared and then supported by a jig 16, as shown in FIG. 6, such that adjacent thin plate parts 15 do not contact each other. Jig 16 is positioned in a basket 11 placed on a tray 13, as shown in FIG. 7.

Referring now to FIG. 1, basket 11 in the aforementioned condition is transported into heating chamber 12, as indicated by arrow ①. Thin plate parts 15 in heating chamber 12 are heated at a temperature of e.g. 850° C. for 15 minutes in a nitrogen ambient. Then, basket 11 is transported by transport table 10 into a carburizing chamber 2 shown on the left side in the figure, as indicated by arrow ②. Thin plate parts 15 are thus carburized at a temperature of e.g. 900° C. for 30 minutes in an ambient of a gas for carburization.

Meanwhile, heating chamber 12 from which basket 11 has been extracted receives another basket 11 which accommodates other thin plate parts 15, as indicated by arrow ③. Thin plate parts 15 in another basket 11 are heated in heating chamber 12 for a predetermined time and then transported by transport table 10 into the carburizing chamber 2 shown on the right side of the figure, as indicated by arrow ④, for carburization.

Thin plate parts 15 carburized in the carburizing chamber 2 shown on the left side of the figure are transported by transport table 10 into gas cooling chamber 1, as indicated by arrow ⑤. By opening valve 6, an inert cooling gas such as nitrogen gas flows from reservoir tank 3 into gas cooling chamber 1 and the pressure in gas cooling chamber 1 thus attains several atmosphere in approximately one second. Thermocouple 5 measures the temperature in gas cooling chamber 1. If the measured temperature exceeds e.g. 150° C., agitator fan 4 agitates the gas in gas cooling chamber 1. When the temperature in gas cooling chamber 1 drops below 150° C., fan 4 stops agitation (FIG. 2). When thin plate parts are completely cooled (quenched), exhaust valve 7 is opened and the pressure in gas cooling chamber 1 thus achieves the atmospheric pressure. Then, transport table 10 extracts basket 11 from gas cooling chamber 1, as indicated by arrow ⑥.

Then, another basket in the carburizing chamber 2 shown on the right side of the figure with the thin plate parts completely carburized is transported by transport table 10 into gas cooling chamber 1, as indicated by arrow ⑦, and thus cooled therein in a similar manner to that described above. When thin plate parts 15 in another basket 11 are completely cooled (quenched) in gas cooling chamber 1, they are extracted from gas cooling chamber 1, as indicated by arrow ⑥. By repeating such a procedure, thin plate parts 15 placed in a plurality of baskets 11 can be successively carburized and quenched.

If there is only one carburizing chamber 2 for one gas cooling chamber 1, thin plate parts 15 are first completely carburized in carburizing chamber 2 and they are then cooled in gas cooling chamber 1 while other thin plate parts 15 are carburized in carburizing chamber 2. However, if the cooling time in gas cooling chamber 1 is shorter than the carburization time in carburizing chamber 2, the thin plate parts 15 in cooling chamber 1 will be completely cooled before the next thin plate parts 15 are completely carburized in carburizing chamber 2. Thus, cooling chamber 1 will not be in use until the next thin plate parts 15 are completely carburized.

By contrast, the carburization and quenching apparatus according to the present embodiment includes a plurality of carburizing chambers 2 for a single gas cooling chamber 1. Thus, if the cooling process in gas cooling chamber 1 is completed before the carburization process in the carburizing chamber 2 shown on the left side of the figure is completed, the thin plate parts 15 that are completely carburized in the carburizing chamber 2 shown on the right side of the figure can be cooled in gas cooling chamber 1. Consequently, gas cooling chamber 1 can be always in use to improve the net working rate of gas cooling chamber 1 and hence the production efficiency of the entire carburization and quenching apparatus.

Since gas cooling chamber 1 is provided with reservoir tank 3 as cooling promotion means for delivering a cooling gas thereinto, a highly pressurized inert gas in reservoir tank 3 delivered into gas cooling chamber 1 allows thin plate parts 15 to rapidly be cooled in gas cooling chamber 1. Gas is slower in the cooling rate of thin plate parts 15 than liquid such as oil, and can be adjusted in pressure and type to readily control the cooling rate of thin plate parts 15. Thus, thin plate parts 15 can achieve the hardness depending on the function, application and the like, and thermal treatment-caused distortion can also be reduced in thin plate parts 15. This eliminates the necessity of distortion removal and can thus reduce the number of the steps for processing thin plate parts 15.

Furthermore, quenching thin plate parts 15 with gas dispenses with the step of washing the liquid (e.g. oil) off thin plate parts 15, as in quenching them with liquid. It is also unnecessary to provide a gas cooling chamber 1 for each carburizing chamber 2, i.e. only one gas cooling chamber 1 is required. Thus, the apparatus can be miniaturized as compared with that with each carburizing chamber 2 provided with a respective gas cooling chamber 1.

Furthermore, since carburizing chambers 2 are provided at an equal distance from gas cooling chamber 1 to surround gas cooling chamber 1, thin plate parts 15 completely carburized in a carburizing chamber 2 can rapidly be moved into and thus cooled in gas cooling chamber 1 to ensure that the thin plate parts 15 are quenched.

Furthermore, agitator fan 4, thermocouple 5 and motor 8 are employed to optimize the temperature in gas cooling chamber 1 so that thin plate parts can be optimally quenched.

Figure 8:
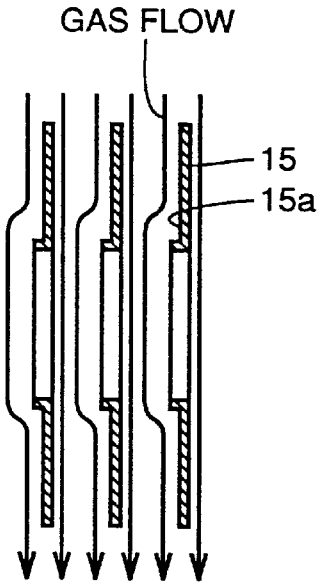
FIG. 8 is a schematic cross section for illustrating a cooling gas flow to which thin plate parts are exposed in the cooling chamber.

While agitator fan 4 is revolved in cooling thin plate parts 15, as shown in FIG. 2, thin plate parts 15 are erected in the vertical direction and equally spaced out, as shown in FIG. 7. Thus, the cooling gas is provided in substantially laminar flows between thin plate parts 15, as shown in FIG. 8. This results in less uneven cooling. Thus, thin plate parts 15 can uniformly be cooled to reduce warpage in thin plate parts 15.

Furthermore, the revolution rate and revolution time of agitator fan 4 can be controlled by an external inverter and a timer to control the cooling rate of thin plate parts 15. Thus, thin plate parts 15 can be relatively rapidly cooled until the temperature of thin plate parts 15 drops to a temperature slightly higher than the martensitic transformation starting point (referred to as the Ms point hereinafter) of thin plate parts 15, and thin plate parts 15 can be relatively slowly cooled when the temperature of thin plate parts 15 drops below the temperature slightly higher than the Ms point, so as to prevent distortion of thin plate parts 15.

Furthermore, thin plate parts 15, enclosed in basket 11, receive heat radiation from basket 11 and the temperature of thin plate parts 15 thus hardly drops while basket 1 is transported from carburizing chamber 2 to gas cooling chamber 1.

It should be noted that the cooling gas is not limited to nitrogen gas and may be other inert gases such as helium. The dimensions of thin plate part 15 can be appropriately changed as required. The temperature in heating chamber 12, the carburizing conditions in carburizing chamber 2 and the like can be appropriate changed depending on the product.

Second Embodiment

Figure 9:
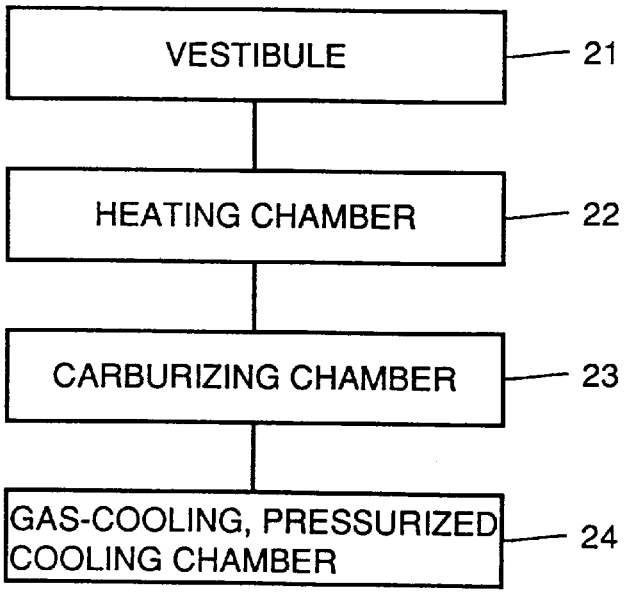
FIG. 9 is a block diagram representing a thin plate part processing device of a continuous furnace according to a second embodiment of the present invention.

Referring to FIG. 9, chambers 21–24 which configure a continuous furnace are first vacuumed by a vacuum pump and then the vacuum is replaced with an inert gas. Then, a gas for carburization is introduced into carburizing chamber 23 and thin plate parts (i.e. work) placed on a tray are inserted via an entrance of the continuous furnace. The thin plate parts are passed through a vestibule 21 and then moved into and thus heated in heating chamber 22 to a desired temperature. Then, the thin plate parts are moved into carburizing chamber 23 for carburization. When the carburization process is completed, the tray is rapidly moved into a pressurized cooling chamber 24 and simultaneously an inert gas such as nitrogen gas is introduced into pressurized cooling chamber 24 for pressurization. In pressurized cooling chamber 24, the agitator fan agitates the inert gas while thin plate parts are cooled (quenched) for each tray.

Quenching a thin plate part as a bearing ring of a thrust bearing by pressurizing and cooling it will now be described.

Referring to FIGS. 4 and 5, a thin plate part 15 as e.g. a bearing ring of a thrust bearing is provided with a hole for inserting an axis thereinto and is thus formed in the shape of a ring.

A plurality of such thin plate parts 15 are suspended by a jig 16 with a predetermined spacing interposed therebetween, and are thus set in basket 11 and on tray 13, as shown in FIG. 7. When thin plate parts 15 thus set are completely carburized, basket 11 and tray 13 are moved by roller hearth, crank or the like and inserted into the sealed cooling container 9 shown in FIG. 2. Simultaneously, valve 6 is opened to introduce into cooling container 9 an inert gas the pressure of which is previously adjusted. Valve 6 is closed after the inert gas is sealed up in cooling container 9. Thereafter, agitator fan 4 provided in cooling container 9 is revolved so that thin plate parts have their main surfaces exposed to and are thus cooled with the gas flows parallel to main surfaces 15*a* of thin plate parts 15, as shown in FIG. 8.

Since thin plate parts 15 are exposed to a cooling gas flowing parallel to main surfaces 15*a* of thin plate parts 15, any turbulence is not caused and thin plate parts 15 can be exposed to well-regulated flows of the cooling gas. If turbulence is caused in the gas flow, thin plate parts 15 are unevenly cooled and thus readily warped. By contrast, when thin plate parts 15 are exposed to well-regulated gas flows, as shown in FIG. 8, uneven cooling is hardly caused so that thin plate parts 15 can uniformly be cooled and are less likely to be warped.

Furthermore, the revolution rate and revolution time of agitator fan 4 is controlled by an external inverter and a timer to control the cooling rate of thin plate parts 15. For example, the rotation rate and rotation time of agitator fan 4 can be controlled to e.g. relatively rapidly cool thin plate parts 15 until the temperature of thin plate parts 15 drops to a temperature slightly higher than the Ms point of thin plate parts 15 and to relatively slowly cool thin plate parts 15 when the temperature of thin plate parts 15 drops below the temperature slightly higher than the Ms point of thin plate parts 15 so as to obtain thin plate parts 15 free from distortion.

When thin plate parts 15 are thus cooled down to the external temperature, exhaust valve 7 is opened to externally discharge the inert gas in cooling container 9 to complete the quenching process.

The inert gas employed in the present embodiment is not limited to nitrogen gas and may be any other gases.

Furthermore, a thin plate part 15 quenched immediately after its carburization is not limited to a bearing ring of a thrust bearing and may be a thin plate part with a thickness of e.g. approximately no more than 1 mm so that the quenching method according to the present invention can be applicable.

According to the thin plate part quenching method according to the present embodiment, a gas such as inert gas is employed to pressurize and cool thin plate parts 15. As such, the cooling rate of thin plate parts is slower than that in quenching them with liquid. Furthermore, the cooling rate of thin plate parts 15 can readily be controlled by adjusting the pressure and type of the gas. Thus, thin plate parts 15 can achieve the hardness depending on the function, application and the like, and thermal treatment-caused distortion can be reduced in thin plate parts 15. This eliminates distortion removal step and can reduce the number of the steps for processing thin plate parts 15.

Quenching thin plate parts with gas also dispenses with the step of washing the liquid (e.g. oil) off thin plate parts 15, as in quenching them with liquid, and can thus reduce the washing step.

Method Employed in Experiment and a Result Thereof

The Inventors examined the respective degrees in thermal treatment-caused distortion of a thin plate part quenched with gas and that quenched with liquid immediately after they are carburized in a continuous furnace. The method employed in the experiment and the experiment result will now be described.

Initially, an SCM415 (JIS) material of 0.78 mm in plate thickness is prepared and the sample is carburized. Immediately thereafter, a sample is salt-bath quenched to obtain a comparative example, and another sample is quenched with a pressurized gas to obtain an example of the present invention. The quenching of a sample with the pressurized gas according to the present invention employs nitrogen gas of 0.54 MPa (absolute pressure) in gas pressure. Then, warpage (thermal treatment-caused distortion) measurements are obtained from the samples (thin plate parts) as a comparative example and an example of the present invention.

In measuring the warpage of a sample, the sample is placed between paralleled plane plates, and a spacing H between the paralleled plane plates with a load of 2.9 kN applied between the plane plates is measured with a 1/100 dial gauge. The plate thickness of the sample is subtracted from the measured spacing H to obtain the warpage measurement of the sample. Table 1 shows the respective warpage measurements of a plurality of samples.

TABLE 1

| Warpage of Sample | Comparative example Liquid Carburization & Salt-Bath Quenching | Present Invention Quenching with Pressurized Gas |
|---|---|---|
| 0 to 0.10 mm | | 4 |
| 0.11 to 0.15 mm | 3 | 27 |
| 0.16 to 0.20 mm | 2 | 21 |
| 0.21 to 0.25 mm | 6 | 11 |
| 0.26 to 0.30 mm | 4 | 4 |
| 0.31 to 0.35 mm | 6 | 1 |
| 0.36 to 0.40 mm | 2 | |
| 0.41 to 0.50 mm | 7 | |
| 0.51 to 0.60 mm | 8 | |
| 0.61 to 0.70 mm | 4 | |
| 0.71 to 0.80 mm | 6 | |
| 0.81 to 0.90 mm | 2 | |
| 0.91 to 1.00 mm | | |
| 1.01 and greater | | |
| $\bar{x}$ | 0.451 min | 0.171 mm |
| $\sigma_{n-1}$ | 0.207 | 0.054 |

The values indicated on the right side of a warpage level represent the ratio in number between the comparative example and the example of the present invention at the warpage level.

It has been found from the above result that more thermal treatment-caused distortion in thin plate parts can be significantly reduced in the present invention than in the comparative example.

It has also been found that the pressure, type and the like of the gas used in quenching can be changed to more readily control the hardness and heat treatment-caused distortion of thin plate parts than in quenching them with liquid.

The Inventors also examined the relation between thermal treatment-caused distortion and the pressure in the cooling container in gas quenching immediately after the carburization process. The method employed in the experiment and the result thereof will now be described.

Figure 10:
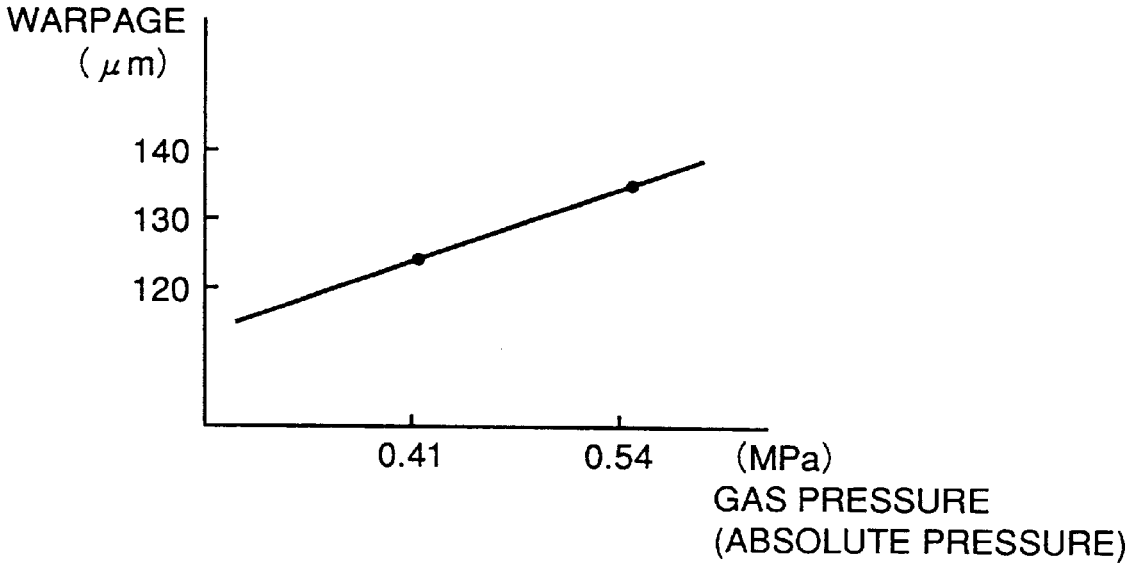
FIG. 10 is a graph of the warpage of a thin plate part versus nitrogen gas pressure in quenching the thin plate part with nitrogen gas.

An SCM415 (JIS) material in 0.78 mm in plate thickness is prepared and the sample is quenched with nitrogen gas used as a cooling gas. The pressure of the nitrogen gas is varied for each sample in measuring the warpage of each sample. The warpage of each sample is measured as in the aforementioned warpage measurement which employs paralleled plane plates. FIG. 10 shows the measurement result.

Referring to FIG. 10, it has been found from the result of the above experiment that higher pressure of the nitrogen gas results in larger warpage. It has also been found that while warpage is reduced for a nitrogen gas pressure of less than 0.20 MPa, sufficiently effective quenching cannot be achieved. It has also been found that a nitrogen gas pressure exceeding 0.49 MPa results in excessive warpage and thus degradation in the bearing characteristics.

From the above result, it has been found that a gas pressure of 0.20 to 0.49 MPa is preferable in the cooling container in employing a gas to quench a part of e.g. a needle bearing immediately after the carburization process.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A carburization and quenching apparatus for carburizing and quenching a thin plate part, comprising:

a plurality of carburizing chambers for carburizing a thin plate part;

a cooling chamber for cooling the thin plate part carburized in said carburizing chamber;

cooling promotion means connected to said cooling chamber, for delivering a cooling gas into said cooling chamber; and cooling means arranged in said cooling chamber to allow the thin plate part to be exposed to the cooling gas flowing substantially parallel thereto, wherein said plurality of carburizing chambers are positioned at an approximately equal distance from said cooling chamber to surround said cooling chamber.

2. The carburization and quenching apparatus according to claim 1, wherein said cooling means is capable of adjusting a cooling rate of the thin plate part cooled with the cooling gas.

3. The carburization and quenching apparatus according to claim 1, wherein said cooling gas is an inert gas.

4. The carburization and quenching apparatus according to claim 1, wherein said thin plate part is a bearing ring of a thrust needle bearing.

5. The carburization and quenching apparatus according to claim 1, further comprising a heating chamber for heating said thin plate part before said thin plate part is carburized.

6. A carburization and quenching apparatus for carburizing and quenching a thin plate part, according to claim 1, wherein said plurality of carburizing chambers are disposed in substantially a same plane as said cooling chamber.

7. A carburization and quenching apparatus for carburizing and quenching a thin plate part, according to claim 1, wherein said cooling chamber and at least one of said plurality of carburizing chambers have a common wall therebetween.

8. A carburization and quenching apparatus for carburizing and quenching a thin plate part, according to claim 1, further comprising a part positioning means to position the thin plate part substantially parallel to the cooling gas flow output from the cooling means.

9. A carburization and quenching apparatus for carburizing and quenching a thin plate part, according to claim 8, wherein the part positioning means comprises a jig attached to a basket.

* * * * *